US009193501B1

(12) United States Patent
Christensen

(10) Patent No.: US 9,193,501 B1
(45) Date of Patent: Nov. 24, 2015

(54) FOLDABLE TANK WITH VARIABLE WIDTH FOR STORING WATER

(71) Applicant: FOL-DA-TANK COMPANY, Milan, IL (US)

(72) Inventor: Chad A. Christensen, Coal Valley, IL (US)

(73) Assignee: FOL-DA-TANK COMPANY, Milan, IL (US)

( * ) Notice: Subject to any disclaimer, the term of this patent is extended or adjusted under 35 U.S.C. 154(b) by 60 days.

(21) Appl. No.: 14/021,359

(22) Filed: Sep. 9, 2013

(51) Int. Cl.
*A45C 7/00* (2006.01)
*B65D 6/00* (2006.01)
*B65D 21/08* (2006.01)

(52) U.S. Cl.
CPC ..... *B65D 21/086* (2013.01)

(58) Field of Classification Search
CPC ..... B65D 90/205; E04H 4/0056; E04H 15/48
USPC ..... 220/9.3, 4.16, 9.2, 4.29
See application file for complete search history.

(56) References Cited

U.S. PATENT DOCUMENTS

| | | | | |
|---|---|---|---|---|
| 5,544,446 | A * | 8/1996 | Benson, Jr. | 47/45 |
| 7,188,747 | B2 * | 3/2007 | Bennett et al. | 220/565 |
| 2007/0278225 | A1 * | 12/2007 | Van Romer | 220/9.4 |
| 2010/0140263 | A1 * | 6/2010 | Claeys | 220/9.3 |
| 2014/0230313 | A1 * | 8/2014 | Elman | 43/124 |

* cited by examiner

*Primary Examiner* — Shawn M Braden
(74) *Attorney, Agent, or Firm* — Shlesinger, Arkwright & Garvey LLP

(57) ABSTRACT

Foldable tank for storing water includes a foldable receptacle having a bottom wall and vertical sidewalls; and a frame to support the sidewalls. The frame has first, second, third, fourth, fifth and sixth sides hingedly joined end-to-end to form an enclosure in an unfolded position during use, the frame having a folded position wherein the sides are collapsed onto each other. The first and second sides are disposed opposite each other defining a width of the receptacle in the unfolded position. The frame includes a first configuration in the unfolded position wherein the third, fourth, fifth and sixth sides are substantially perpendicular to respective first and second sides; and a second configuration in the unfolded position wherein the third, fourth, fifth and sixth sides include an angle with respective the first and second sides greater than 90°, wherein the width is variable between the first configuration and the second configuration.

7 Claims, 5 Drawing Sheets

FOLDABLE TANK WITH VARIABLE WIDTH FOR STORING WATER

FIELD OF THE INVENTION

The present invention is directed generally to a foldable tank for storing water for fire fighting and specifically to a foldable water tank with adjustable width for use on narrow roads and with a foldable frame that folds substantially flat for storage and transport.

SUMMARY OF THE INVENTION

The present invention provides a foldable tank 2 for storing water comprises a foldable receptacle 6 having a bottom wall 8 and vertical sidewalls 10; and a frame 4 to support the sidewalls in an upright position (see FIG. 1). The frame has first and second sides 16, and third, fourth, fifth and sixth sides 18 hingedly joined end-to-end to form an enclosure in an unfolded position during use (see FIGS. 2 and 5), the frame having a folded position wherein the sides 16 and 18 are collapsed onto each other (see FIG. 4). The first and second sides 16 are disposed opposite each other defining a width 38 of the receptacle in the unfolded position during use (see FIGS. 2 and 5). The third side has one end hingedly connected to one end of the first side 16 and a fourth side having one end hingedly connected to another end of the first side 16. The fifth side 18 has one end hingedly connected to one end of the second side 16 and a sixth side having one end hingedly connected to another end of the second side 16. The third side 18 has another end hingedly connected to another end of the of the fifth side 18. The fourth side 18 has another end hingedly connected to another end of the sixth side 18. The frame includes a first configuration in the unfolded position during use wherein the third, fourth, fifth and sixth sides 18 are substantially perpendicular to respective the first and second sides 16 (see FIG. 5); and a second configuration in the unfolded position during use wherein the third, fourth, fifth and sixth sides 18 include an angle with the respective first and second sides 16 greater than 90° (see FIG. 2), wherein the width 38 is variable between the first configuration and the second configuration.

DETAILED DESCRIPTION OF THE INVENTION

Figure 1:
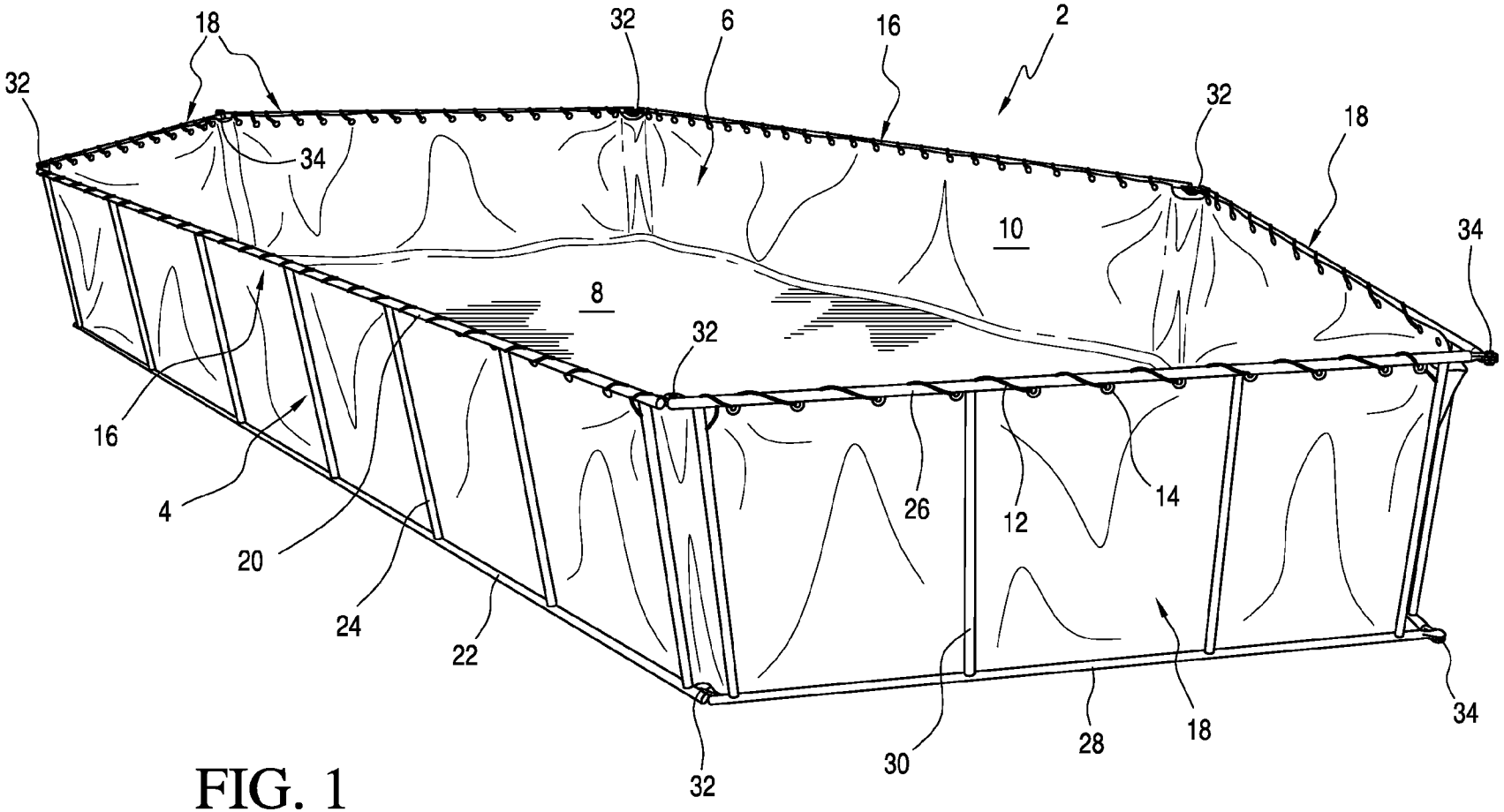
FIG. 1 is a perspective view of a foldable tank embodying the present invention.
Figure 2:
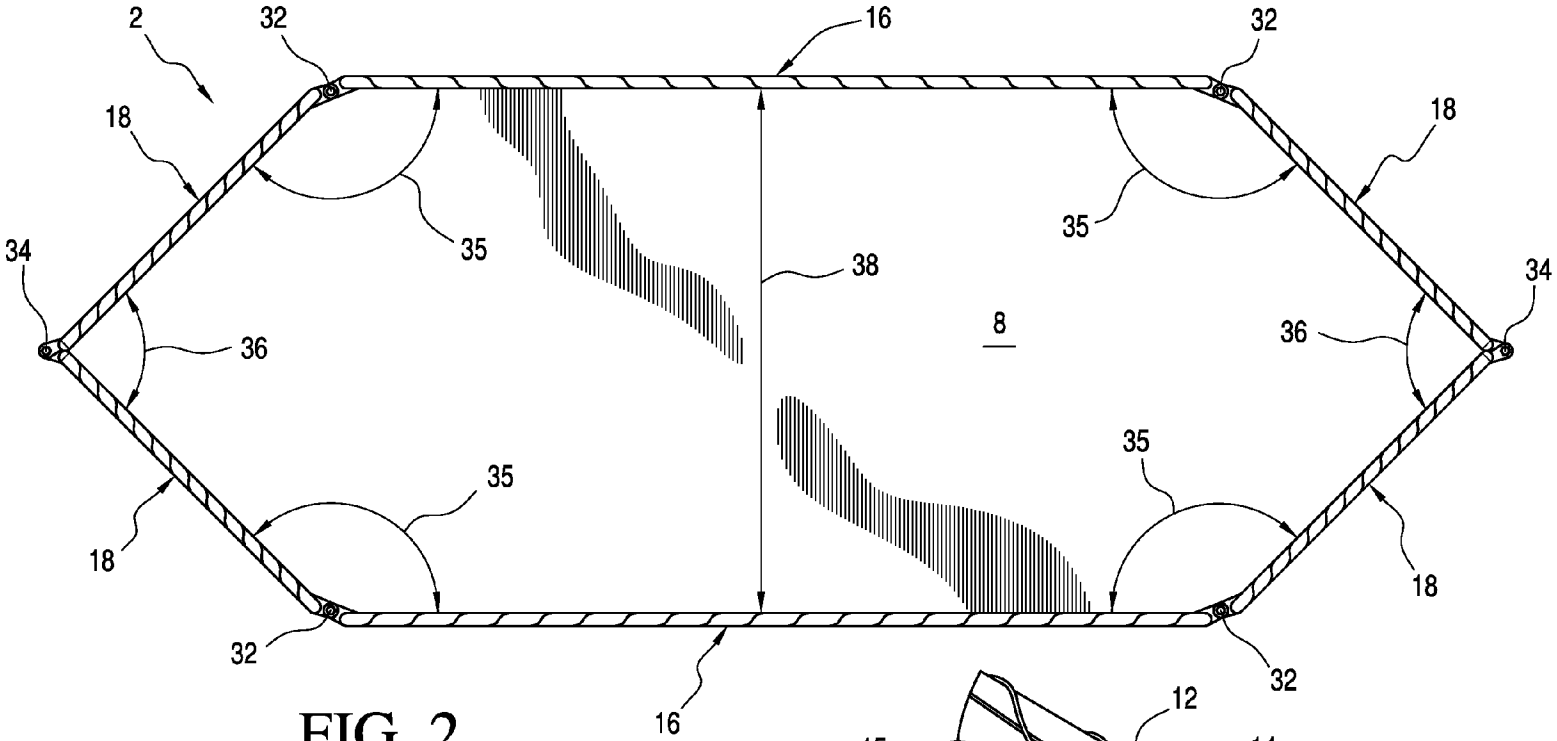
FIG. 2 is a top view of FIG. 1.
Figure 3:
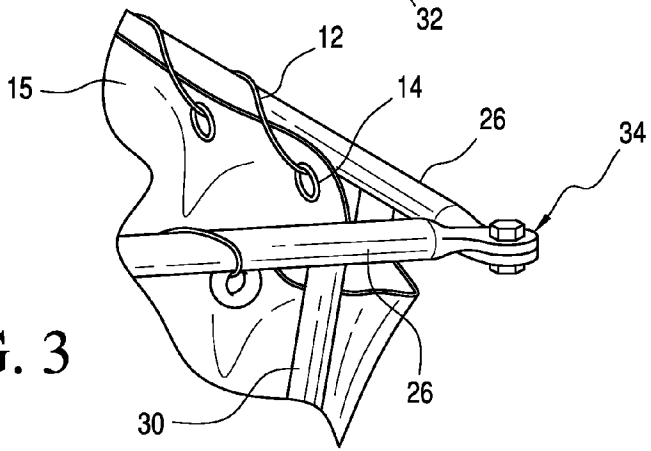
FIG. 3 is an enlarged perspective view of a portion of the tank shown in FIG. 1.

Referring to FIGS. 1, 2 and 3, a foldable water tank 2 made in accordance with the present invention is disclosed. The tank 2 has a folding frame 4 and a flexible receptacle 6 made from conventional, foldable, watertight material. The receptacle 6 has a bottom wall 8 and vertical sidewalls 10 secured to the frame 4 with a rope 8 or similar material threaded through openings 14 along the upper edge portion 15 of the vertical sidewalls 10 and wound around the upper rails of the frame. The frame 4 forms an enclosure and a freestanding structure to provide support to the sidewalls 10 in the vertical position so as to keep the receptacle 6 in an open unfolded position ready to receive water.

The frame 4 is preferably 6-sided. The frame 4 has a pair of opposite sides 16 and two pairs of opposite sides 18. Each side 16 includes an upper rail 20, a bottom rail 22 and a plurality of vertical posts 24 joining the bottom rail to the respective upper rail. Each of the sides 18 includes an upper rail 26 and a bottom rail 28 and a plurality of posts 30 joining the bottom rails to the upper rails. The frame 4 is preferably ladder-shaped, but other forms of frames may be used.

The frame 4 is preferably made from tubular members of any cross-sectional shape, such as square or circular. The sides 16 disposed opposite to each other in the unfolded position ready to be used. Hingedly connected pairs of sides 18 are hingedly connected to respective ends of the sides 16 with hinges 32. Each pair of sides 18 are attached to each other with hinges 34. The hinges 32 and 34 advantageously allow the frame 4 to be folded into a compact, substantially flat configuration, where the sides 16 and 18 are collapsed onto each other, with the top and bottom rails of the sides 16 and 18 being substantially parallel to each other, as shown in FIG. 4.

Figure 4:
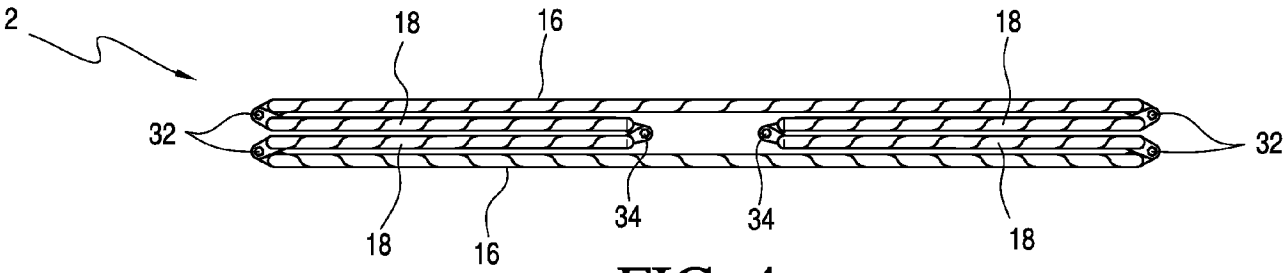
FIG. 4 is a top view of FIG. 1, showing the tank in the folded position for stowage.

Referring back to FIG. 2, the hinges 32 allow the sides 16 and the adjacent sides 18 to pivot through an angle 35 ranging from about 0° when the tank 2 is folded to about 90°, as shown in FIG. 4, and to about 135°. At the 90° position shown in FIG. 4, the tank's width 38 is at its largest and the tank 2 may be used at this configuration. At the 135° position shown in FIG. 2, the tank's width 38 is at its smallest and the tank may be used at this configuration. The tank's width may be adjusted to any desired dimension between the largest shown in FIG. 5 to the smallest shown in FIG. 2, depending on the space on which the tank is laid down.

Figure 5:
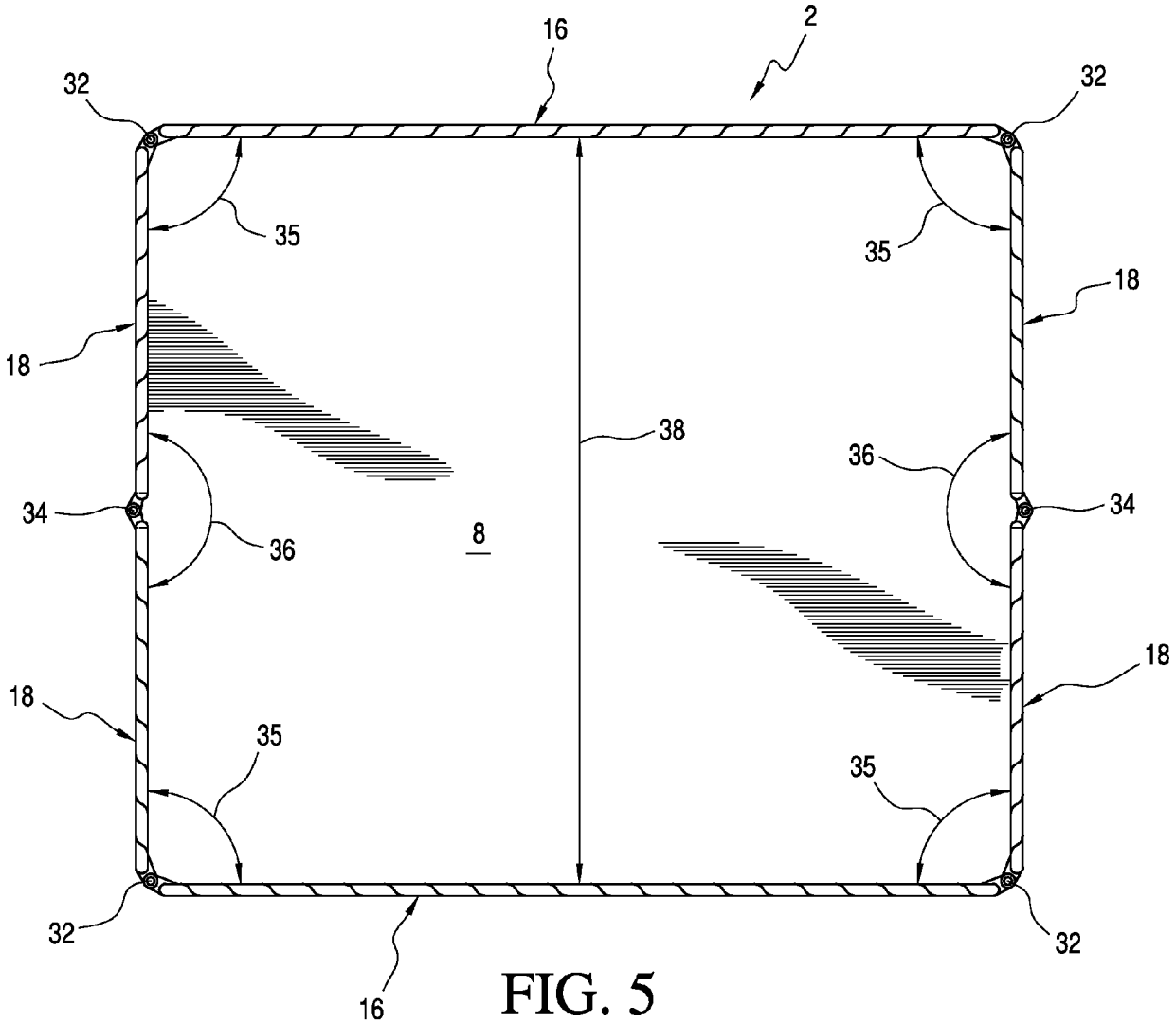
FIG. 5 is a top view of the tank of FIG. 1, showing the tank in an unfolded, maximum width configuration.

In similar fashion, the hinges 34 allow the sides 18 of each pair of sides 18 pivot through an angle 36 from about 360° when the tank 2 is folded as shown in FIG. 5, to about 180° at the tank's maximum width configuration and to about 90° at the tank's minimum width configuration.

Figure 9:
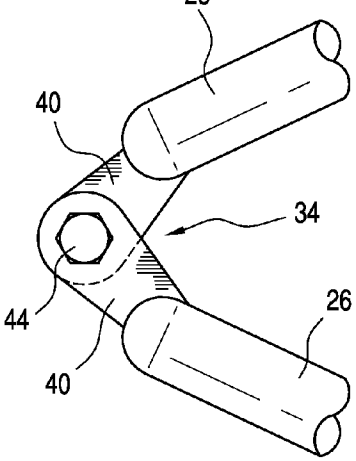
FIGS. 8 and 9 are enlarged partial top views of the hinge of FIG. 7, showing the hinge in various positions during the folding or unfolding of the tank.
Figure 8:
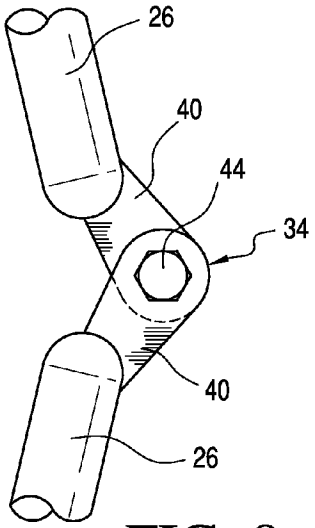
Figure 7:
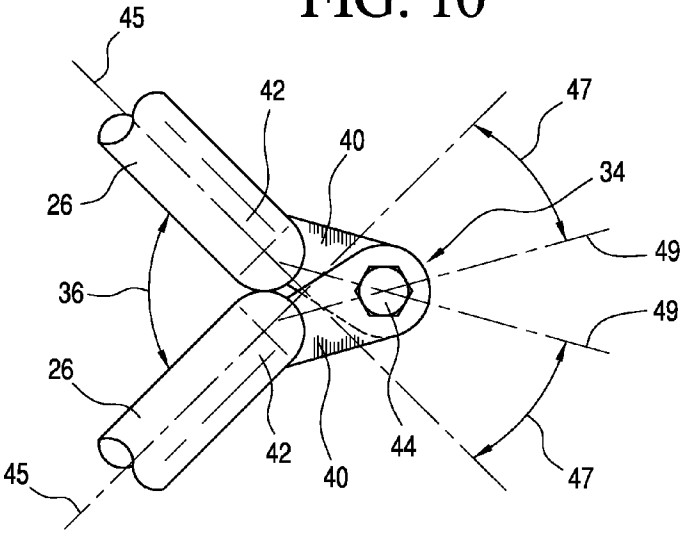
FIG. 7 is an enlarged partial top view of a hinge used in the unfolding and folding of the tank of FIG. 1, showing the hinge when the tank is unfolded to the configuration shown in FIG. 2.

Referring to FIG. 7, the hinge 34 includes arms 40 attached to end portions 42 of the respective top rails 26 and a pivot 44 joining the arms 40. The arms 40 are attached to the end portions 42 at an offset 47 from the longitudinal axes 45 of the respective rails 26 and the longitudinal axes 49 of the arms 40. The offset advantageously allows the end portions 42 to engage against one another to provide a stop to further rotation of the hinge 34. Engagement of the end portions 42 occurs when the inside angle 36 is about 90°. Other means may be used to provide the stop function. It is preferable to provide a stop to the rotation of the hinge 34 for quicker and positive setup, since the stop would give the user feedback when maximum travel of the hinge 34 is reached from the folded position to the minimum width configuration shown in FIG. 2. FIGS. 8 and 9 show the various positions of the hinge 34 as it pivots from the folded position, shown in FIG. 4, to the maximum width configuration shown in FIG. 5. The hinge 34 attached to the bottom rails 28 works the same way.

Figure 6:
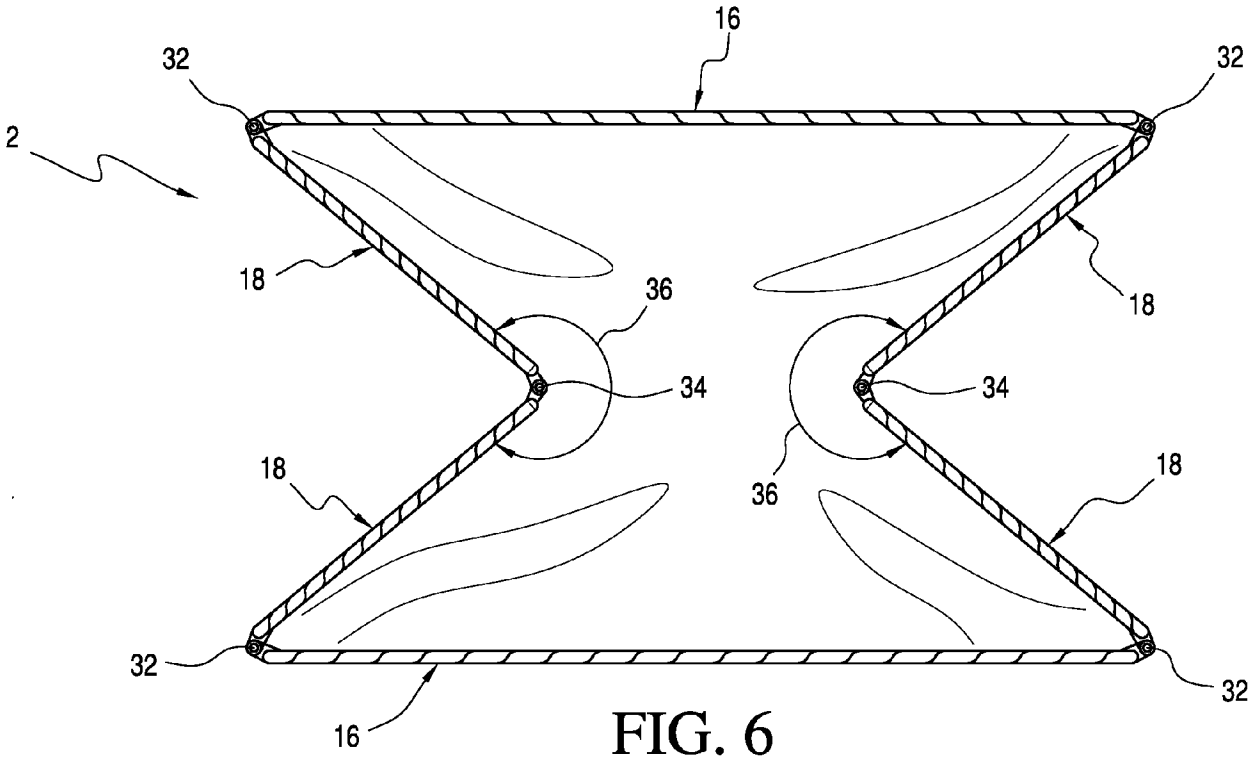
FIG. 6 is a top view of the tank of FIG. 1, showing the tank in a partially folded position midway between the configurations shown in FIGS. 4 and 5

The frame 4 is shown partially folded in FIG. 6. The hinges 32 and 34 advantageously allow the inward rotation of the sides 18 toward the respective sides 16 such that the tank 2 may be folded into a compact, substantially flat and collapsed shape. The hinges 32 and 34 advantageously allow rotation of the sides 18 to accomplish the folding and unfolding feature of the tank 2.

The adjustability of the width 38 of the tank is put into use when the tank is laid on a narrow road. When using the road surface on which to lay the tank 2, it is preferable that the roadway is not completely blocked so traffic can still pass through. Depending on the available width of the roadway, the width 38 of the tank 2 is adjusted so as to occupy only part of the roadway to allow trucks and other vehicles to still pass through.

Figure 10:
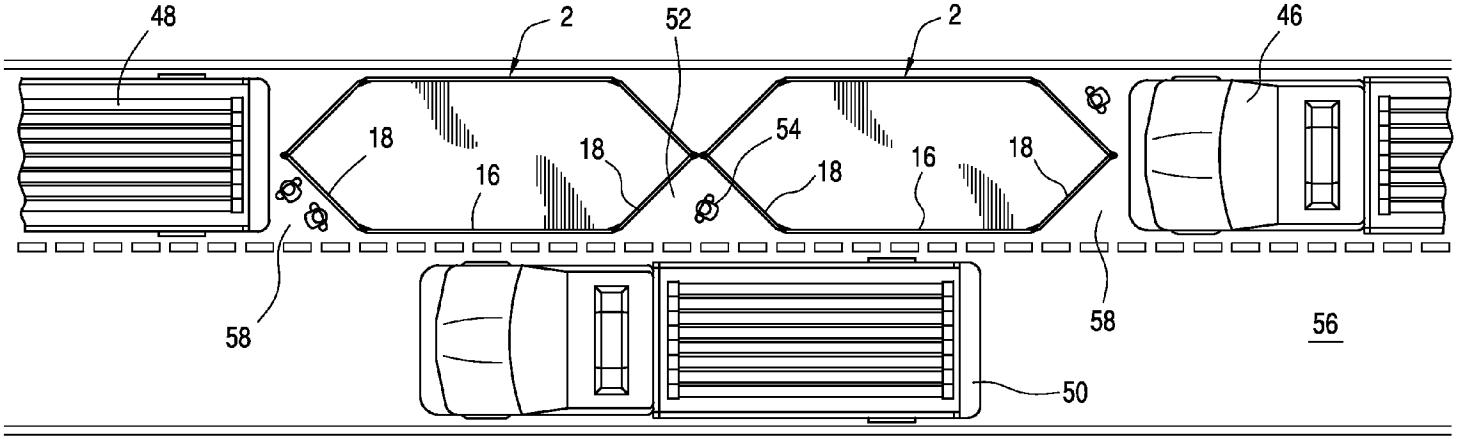
FIG. 10 is a top view of several tanks of FIG. 1, showing the tanks arranged end-to-end on a narrow road.

Referring to FIG. 10, two tanks 2 are arranged inline on one lane of a two lane road. The width of the tanks 2 are adjusted so as not to encroach or extend into the other lane, leaving the other lane open for vehicular traffic. A fire truck 46 is parked at one end of the inline tanks 2. Another fire truck 48 is parked at the opposite end of the inline tanks 2. Due to the adjustability of the width 38 of the tanks 2, the tanks are unfolded to the right width that will fit within the blocked lane of the road so that the other travel lane of the road can remain active to allow other fire trucks or vehicles to pass unimpeded, such as a fire truck 50 shown in FIG. 10.

Between the two tanks 2, a safety zone 52 is created where a worker 54 may safely move about and be relatively protected from vehicles moving on the active travel lane 56. Other safety zones 58 are formed between the respective tank 2 and the fire trucks 46 and 48. The safety working zones 52 and 58 are physically defined by the sides 18 of the tanks and the sides of the fire trucks so that the workers are guided to stay within their boundaries. Similarly, the sides 16 provide a visual guide for the drivers of the moving trucks to stay on the travel lane.

Although storing water for firefighting use is disclosed as the primary application of the present invention, the foldable tank may also be used for storing other liquids for other applications, such as for environmental clean up of oil spills.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

I claim:

1. Foldable tank for storing water, comprising:

a) a foldable receptacle having a bottom wall and vertical sidewalls;

b) a frame to support said sidewalls in an upright position;

c) said frame having first, second, third, fourth, fifth and sixth sides hingedly joined end-to-end to form an enclosure in an unfolded position during use, said frame having a folded position wherein said sides are collapsed onto each other;

d) said first and second sides disposed opposite each other at a distance defining a width of said receptacle in said unfolded position during use;

e) said third side having one end hingedly connected to one end of said first side and said fourth side having one end hingedly connected to another end of said first side;

f) said fifth side having one end hingedly connected to one end of said second side and said sixth side having one end hingedly connected to another end of said second side;

g) said third side having another end hingedly connected to another end of said fifth side;

h) said fourth side having another end hingedly connected to another end of said sixth side;

i) said frame includes a first configuration in said unfolded position during use wherein said third, fourth, fifth and sixth sides are substantially perpendicular to respective said first and second sides;

j) said frame includes a second configuration in said unfolded position during use wherein said third, fourth, fifth and sixth sides include an interior angle with respective said first and second sides greater than 90°, wherein said interior angle is included within said receptacle and said width is variable between said first configuration and said second configuration; and k) said another ends of said third, fourth, fifth and sixth sides include stops to limit rotation of said third, fourth, fifth and sixth sides from said unfolded position to said second configuration to about 90° of an interior angle included within said enclosure with respective said third, fourth, fifth and sixth sides.

2. Foldable tank as in claim 1, wherein said frame includes top rails and bottom rails, and vertical posts joining said top rails to said bottom rails.

3. Foldable tank as in claim 2, wherein said first, second, third, fourth, fifth and sixth sides are hingedly connected at respective ends of said top rails and said bottom rails.

4. Foldable tank as in claim 1, wherein said third, fourth, fifth and sixth sides are rotatable from said folded position to said first configuration to about 90° of an interior angle included within said enclosure with respective said first and second sides.

5. Foldable tank as in claim 2, wherein said vertical sidewalls are supported from said top rails.

6. Foldable tank as in claim 5, wherein:

a) said vertical sidewalls include upper edge portions;

b) said upper edge portions include openings; and c) rope wound around said top rails and threaded through said openings.

7. Foldable tank as in claim 1, wherein hinges connecting said third side to said fifth side, and said fourth side to said sixth side each includes pivot disposed laterally from longitudinal axes of respective associated said third and fifth sides, and said fourth and sixth sides.

* * * * *